US006750772B2

(12) United States Patent
Skerker et al.

(10) Patent No.: US 6,750,772 B2
(45) Date of Patent: Jun. 15, 2004

(54) REFRIGERATOR ALARM

(75) Inventors: Robert B Skerker, Buffalo, NY (US); Ho Wai Ming, Hong Kong (HK)

(73) Assignee: Robinson Knife Manufacturing Co., Inc., Buffalo, NY (US)

( * ) Notice: Subject to any disclaimer, the term of this patent is extended or adjusted under 35 U.S.C. 154(b) by 428 days.

(21) Appl. No.: 09/837,727

(22) Filed: Apr. 18, 2001

(65) Prior Publication Data

US 2002/0154021 A1 Oct. 24, 2002

(51) Int. Cl.[7] ..... G08B 17/00
(52) U.S. Cl. ..... 340/585; 340/584
(58) Field of Search ..... 340/529, 540, 340/545.6, 585, 586, 587, 588, 584; 62/127, 129, 130, 131; 165/48.1, 254

(56) References Cited

U.S. PATENT DOCUMENTS

| | | | | | |
|---|---|---|---|---|---|
| 3,959,787 | A | * | 5/1976 | Messmann et al. | 340/585 |
| 5,217,064 | A | * | 6/1993 | Kellow et al. | 165/48.1 |
| 5,917,416 | A | * | 6/1999 | Read | 340/584 |
| 6,060,987 | A | * | 5/2000 | Marlia | 340/540 |
| 6,401,466 | B1 | * | 6/2002 | Olsen | 62/131 |

* cited by examiner

*Primary Examiner*—Van T Trieu
(74) *Attorney, Agent, or Firm*—Hedman & Costigan, P.C.

(57) ABSTRACT

A battery operated refrigerator alarm having a light sensor for sensing light, a timer, a temperature sensor for sensing temperature, and an alarm indicator. The alarm indicator may have an audio and/or visual indicator. The refrigerator alarm can placed in the refrigerator or mounted to an interior surface or onto a shelf.

17 Claims, 7 Drawing Sheets

REFRIGERATOR ALARM

FIELD OF THE INVENTION

The present invention relates to the field of alarms for temperature controlled environments and particularly to the field of alarms for refrigerators and the like.

BACKGROUND OF THE INVENTION

Refrigerated compartments are often used to store and preserve temperature sensitive goods. If the cooling system in a refrigerated compartment fails, the temperature sensitive goods can become spoiled, degraded or deteriorated. In large commercial and industrial refrigerated container systems alarms are often used to provide a warning when the compartment temperature becomes too warm or too cold.

However, smaller refrigerators typically used in the home and small businesses are not manufactured with a temperature alarm. Installing an alarm system into a refrigerator can be impractical since it is difficult to retrofit a refrigerator to accommodate an alarm system that draws electronic power from the main power supply of the cooling system. As such, there is a need for a battery operated temperature sensing alarm that can easily be installed in a refrigerator.

SUMMARY OF THE INVENTION

The present invention is directed to a battery operated refrigerator alarm comprising a light sensor, a timer, a temperature sensor and an alarm indicator. The light sensor is associated with the timer and the alarm indicator is activated when light is detected by the light sensor for a predetermined period of time. The temperature sensor comprises at least an upper predefined temperature wherein the alarm indicator is triggered if the temperature rises above the upper predefined temperature.

The alarm indicator may include an audio signal, a light signal or a combination of both. The light sensor and temperature sensor may activate the same alarm indicator or a plurality of alarm indicators can be used. Preferably the alarm indicator includes three indicator lights that operate based upon the temperature sensor, comprising a first light to indicate a high temperature, a second light to indicate a low temperature and a third light to indicate normal temperature.

The refrigerator alarm of the present invention can be placed or mounted inside a refrigerator. Preferably, the alarm is mounted in the refrigerator by mounting means. In one embodiment, the mounting means would include an elongated upper arm and an elongated lower arm extending from the alarm body, with at least one of said upper and lower arms being movable in relation to the other arm and including means to maintain the arms in a fixed, closed position about a refrigerator shelf. In the most preferred embodiment, the alarm body would be mounted to a surface with mounting means including double sided tape, suction cups or the like, preferably with a mounting bracket secured to the interior refrigerator surface that includes means to hold the alarm.

BRIEF DESCRIPTION OF THE DRAWINGS

The attached drawings, in which like reference characters represent like parts, are intended to illustrate the invention without limiting the invention in any manner whatsoever.

DETAILED DESCRIPTION OF THE PREFERRED EMBODIMENT

Figure 1:
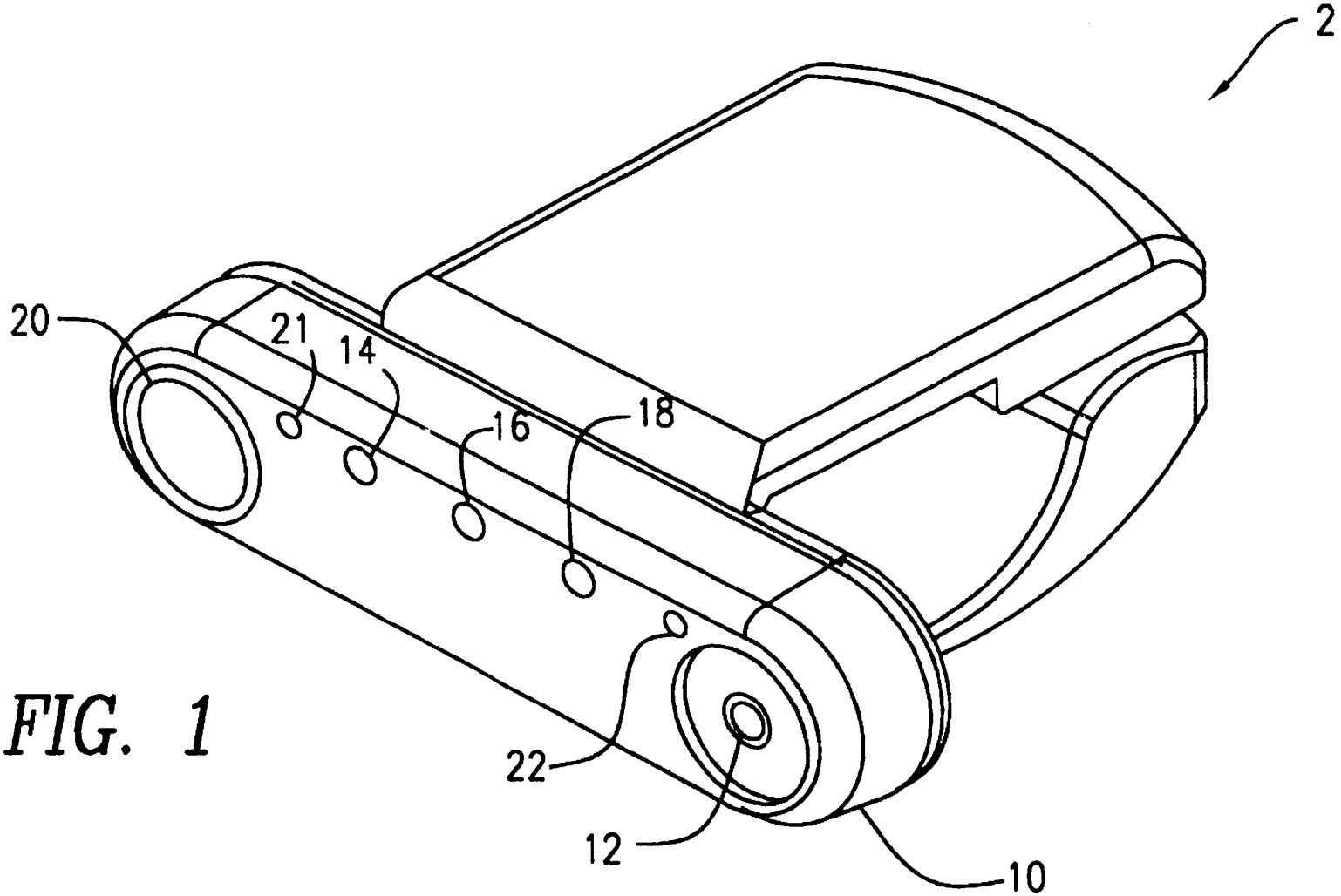
FIG. 1 is a perspective front view of an embodiment of the present invention.

With reference to the drawings, and particularly FIGS. 1–4, the preferred embodiment of the refrigerator alarm 2 of the present invention comprises an alarm body 10, a light sensor 12, a timer, a temperature sensor 20 and an alarm indicator.

The light sensor 12 works in combination with the timer so that once light is sensed, the timer will begin. When a predetermined period of time has passed during which light is continuously detected, the alarm indicator will be activated to alert the user that the refrigerator door has been left open for the predetermined period of time.

The alarm indicator associated with the light sensor remains inactive in a dark environment, such as when the refrigerator door is closed. If the door is opened and the light sensor 12 is exposed to light for a predetermined period of time, the alarm indicator will be activated. In its preferred embodiment, a user adjustable light exposure period of 1 to 10 minutes is contemplated. The preferred light exposure period is 2 to 3 minutes, which is longer than the period normally required to access the contents of a refrigerator.

The refrigerator alarm 2 preferably has an adjustable delay time switch 22. By changing the setting on the adjustable delay time switch 22 the period of delay between sensing light and triggering of the alarm can be changed.

In the event that the light sensor 12 does not detect light, the time is reset and the alarm indicator is deactivated. In its most preferred embodiment, the refrigerator alarm 2 includes a manually activated switch 21, such as a button, toggle or touch sensor, to deactivate the alarm indicator. The manual switch 21 can be adapted to disable the alarm indicator entirely until the light sensor 12 does not detect light or to reset the timer to begin a new timed period until alarm activation.

The refrigerator alarm 2 also includes a temperature sensor 20 to identify when the temperature of the refrigerator compartment rises above a preferred maximum operating temperature. In the event that the preferred maximum operating temperature is exceeded, an alarm indicator is activated to alert the user of the high temperature condition. In its most preferred embodiment, the temperature sensor 20 is associated with both a preferred maximum operating temperature and a preferred minimum operating temperature so that the user is also alerted when the temperature of the refrigerator is too low.

The alarm indicator can comprise an audio indicator, such as a buzzer, a beeper, a voice message or the like. Likewise, the alarm indicator can be a visual indicator such as an illuminated light or a flashing light and can utilize one or more colors. Most preferred, however, is a combination of both audio and visual indicators.

In this regard, the alarm indicator can be the same for the light sensor activation and for the temperature sensor activation, i.e. a buzzer indicating that a predetermined period of light has been sensed and/or the temperature exceeds the preferred maximum and/or minimum operating temperature. Most preferred, however, are separate alarm indicators for separate conditions. For example, a beeping audio indicator can signal that light has been sensed for a period of time exceeding the predetermined period and an LED indicator can show when the temperature exceeds the preferred maximum and/or minimum operating temperature.

In a most preferred embodiment, the alarm indicator is such that if the compartment becomes elevated above a predetermined maximum operating temperature, the alarm will sound a high temperature warning and an LED 18 will be illuminated. The LED 18 will also flash when the surrounding temperature becomes elevated above a certain temperature and light is sensed by the light sensor 12. The LED 18 is preferably red to signal the elevated temperature. The high temperature setting can be between 0° F. and 50° F. although the preferred maximum operating temperature setting will be about 38–42° F. in a refrigerator.

The alarm indicator may be designed so that it will also be activated when the compartment temperature falls below a certain level (minimum operating temperature). In this case a separate yellow LED 16 is preferably activated when the temperature falls below a certain level. A minimum temperature setting can be −20° F. to 34° F. although the preferred minimum setting is between about 33° F. and 35° F., with about 34° F. being the most preferred in a refrigerator.

In the most preferred example, an LED 14 is used to indicate when the temperature is between the maximum operating temperature setting and the minimum operating temperature. Preferably a green LED 14 will be used to indicate when the refrigerator temperature is in this normal operating temperature range.

In another embodiment the alarm indicator will include three audible or alarm sounds. One sound will indicate high temperature, a second sound will indicate low temperature and a third sound will indicate that the light sensor has detected light for a predetermined period of time.

Although the alarm of the present invention can merely be placed in the refrigerator, it is preferably mounted in the refrigerator. In one embodiment, the alarm body 10 includes an upper arm 26 and a lower arm 28, both of which may be elongated. The refrigerator alarm 2 can then be attached to a refrigerator shelf by sliding the upper arm 26 over and the lower arm 28 below the refrigerator shelf. The preferred attachment of the alarm 2 to a refrigerator shelf can best be seen in FIG. 3.

In this embodiment, at least one of the upper arm 26 and the lower arm 28, and preferably the lower arm 28, is connected with a spring loaded hinge 30 and is pivotable. The lower arm 28 also preferably has a curved end 32 which clears the shelf lip but comes in contact with the refrigerator shelf bottom when the alarm body 10 is in the closed position. The upper arm 26 preferably has a flat surface 34 that provides a large surface area of contact with the refrigerator shelf top.

Figure 7:
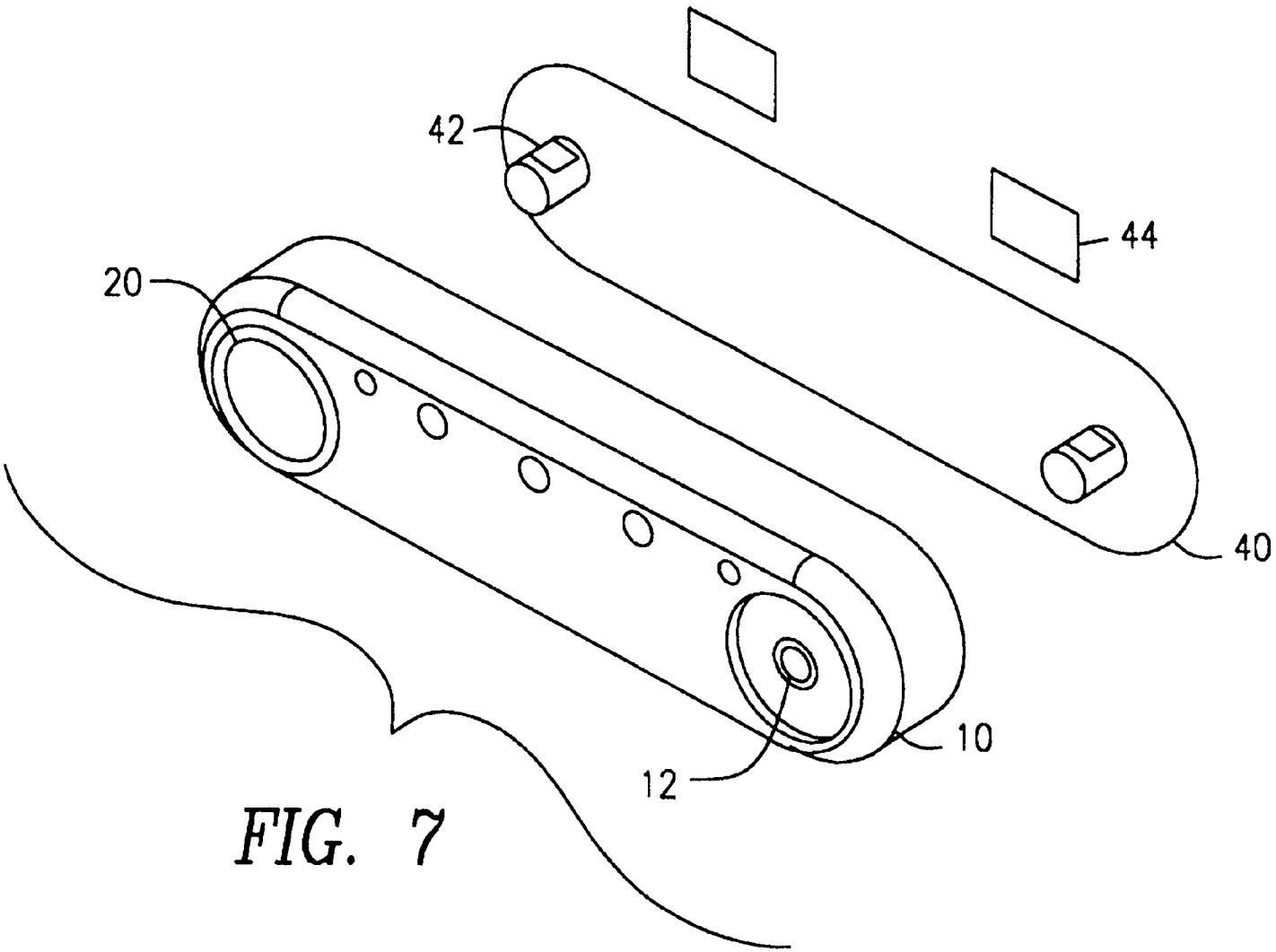
FIG. 7 is a perspective view of the front of the preferred embodiment of the present invention.
Figure 8:
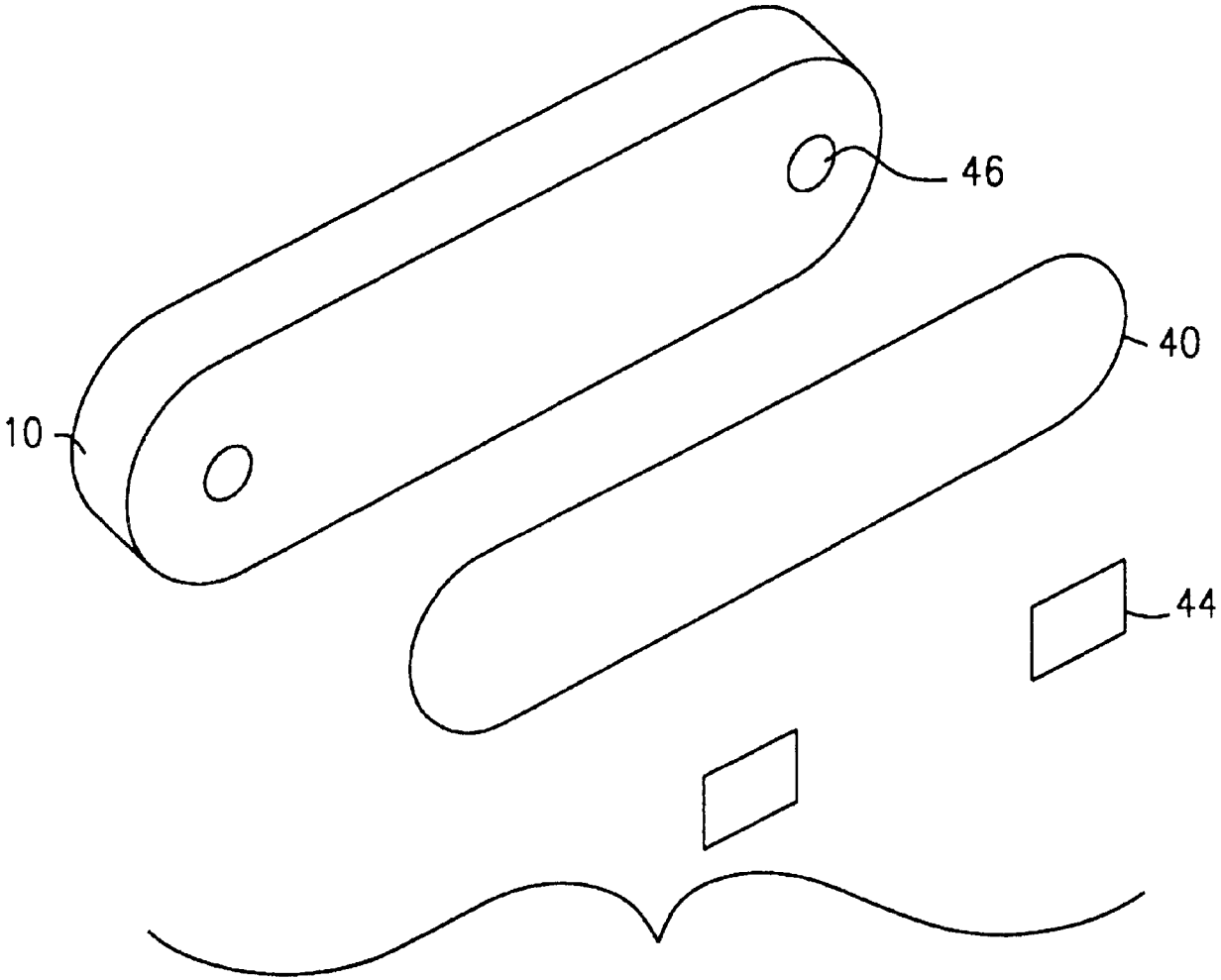
FIG. 8 is a perspective view of the rear of the preferred embodiment of the present invention.

In another embodiment the alarm is mounted to a surface on the interior of the refrigerator by mounting means. This can be achieved by double sided tape, suction cups, Velcro or other such means suitable for such mounting, as is known to those skilled in the art. Although the alarm body 10 can be mounted directly to the interior surface, it is preferred that the alarm body be mounted via a mounting bracket 40 as shown in FIGS. 7 and 8. The preferred mounting bracket 40 incorporates connection means such as a plurality of fasteners 42 which engage cooperating receptacles 46 on the back of the alarm body 10. Double sided tape 44, suction cups, Velcro or the like is used to attach the mounting bracket 40 to the interior surface of the refrigerator to complete mounting of the alarm 2.

Figure 2:
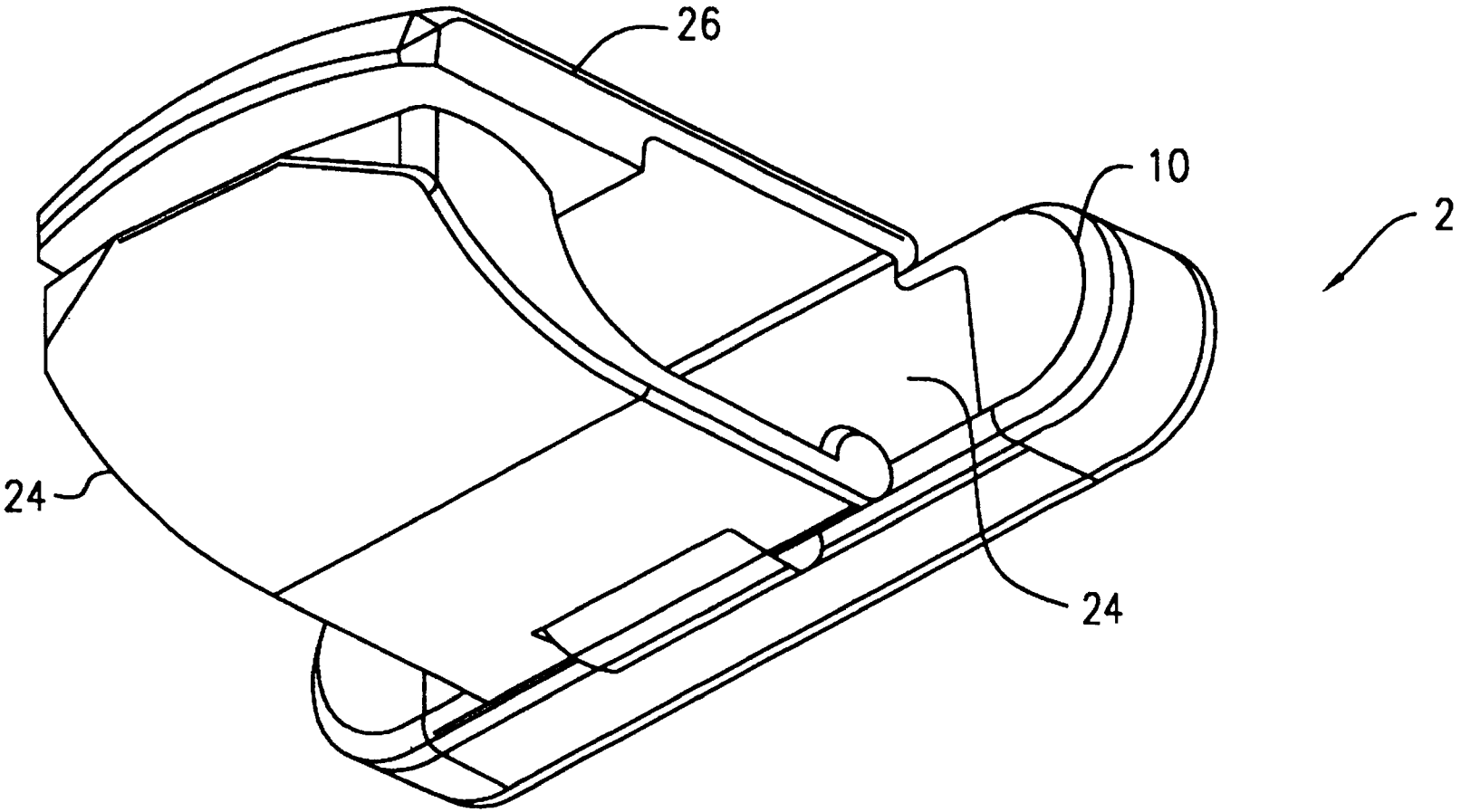
FIG. 2 is a perspective rear view of the embodiment of the present invention shown in FIG. 1.
Figure 3:
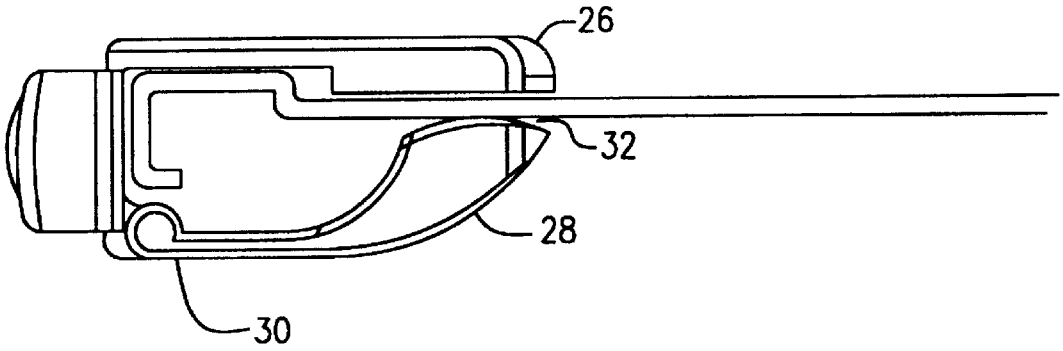
FIG. 3 is a side view of the embodiment of the present invention of FIG. 1 as attached to a refrigerator shelf.
Figure 4:
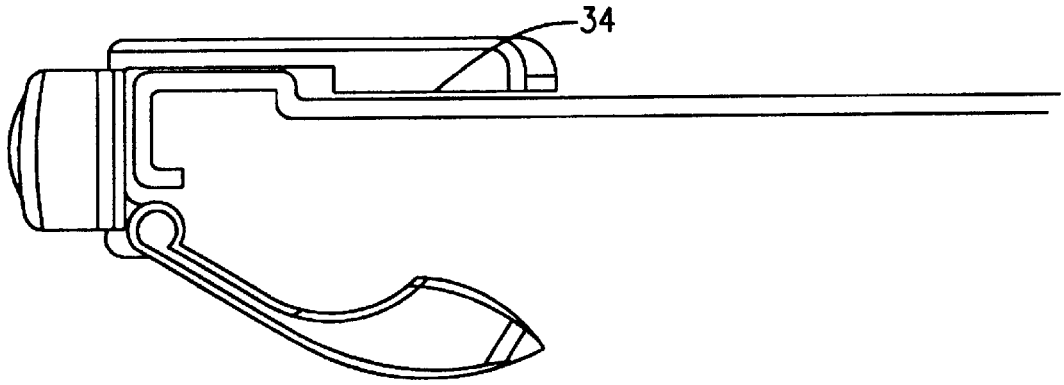
FIG. 4 is a side view of the embodiment of the present invention shown in FIG. 1 with the arm of the alarm body in the open position.

The alarm 2 is preferably powered by battery and the alarm body 10 also includes a battery compartment 24, best seen in FIG. 2. Two AAA batteries providing 3V has been found suitable for this application.

Figure 5:
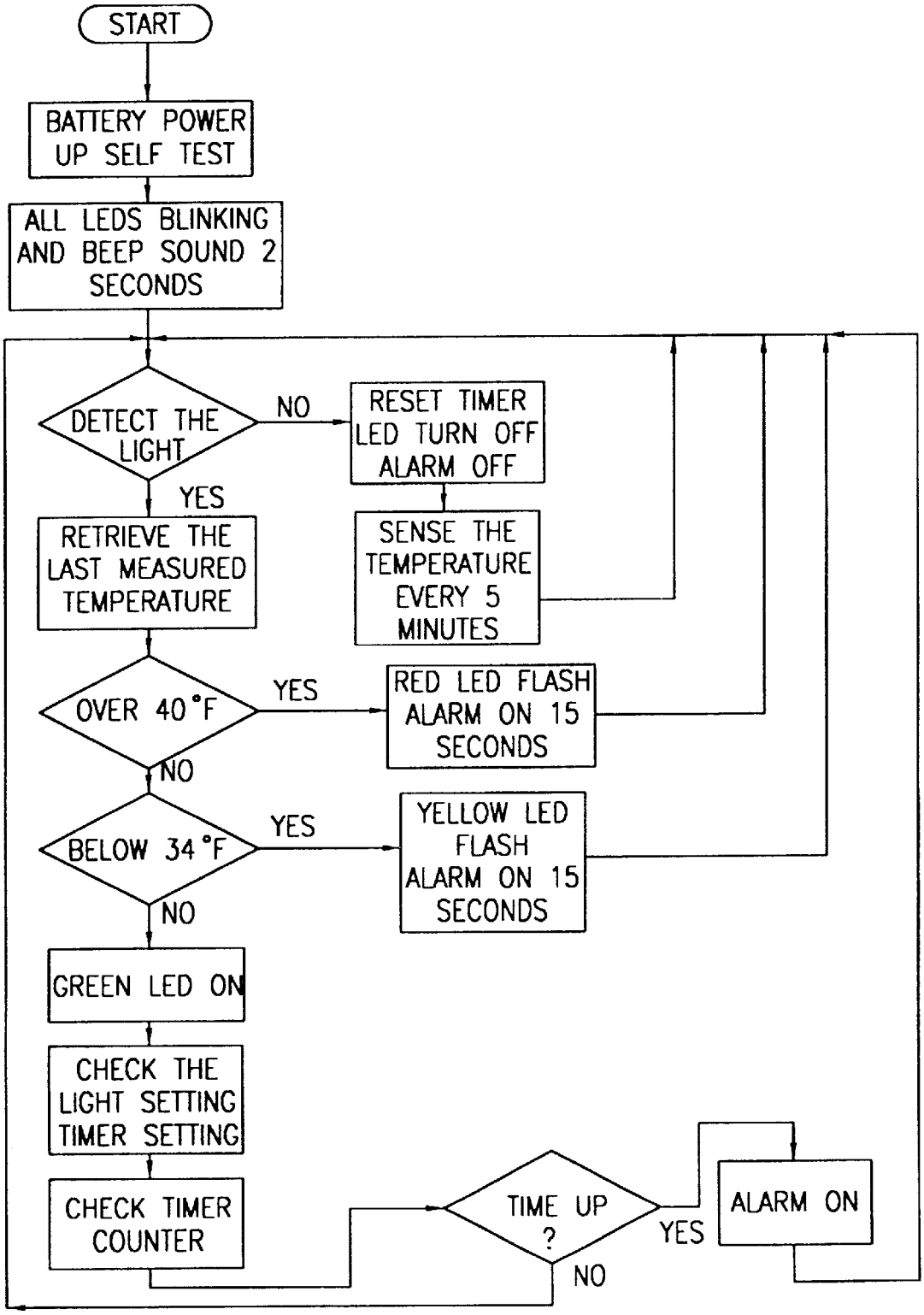
FIG. 5 is a flow chart of the operation of the present invention.

In operation, the refrigerator alarm 2 provides an alarm when changes have occurred in the refrigerator compartment, such as when the compartment is either too hot or too cold or when the light sensor 12 determines that the door has been left open. FIG. 5 is a flowchart of an example of the operation of the preferred embodiment of the invention.

As shown in FIG. 5, when the electrical power is first turned on to the alarm a battery power up self test is performed. In addition, the LED'S and audio are tested for 2 seconds.

In the event that the light sensor 12 does not detect light the timer is reset and the visual LEDs and audio alarm are turned off and set to read the temperature every 5 minutes.

In the event that the light is detected by the light sensor 12 the last temperature measured by the temperature sensor 20 is retrieved. If the temperature is over 40° F. the red LED 18 flashes for 15 seconds. If the temperature is less that 40° F. but not below 34° F. then the green LED 14 is flashed. The light sensing timer setting is then checked and the timer counter is checked. If the time is up the alarm is activated.

If the temperature is below 34 F.° the yellow flashing LED alarm is set on for 15 seconds.

Figure 6:
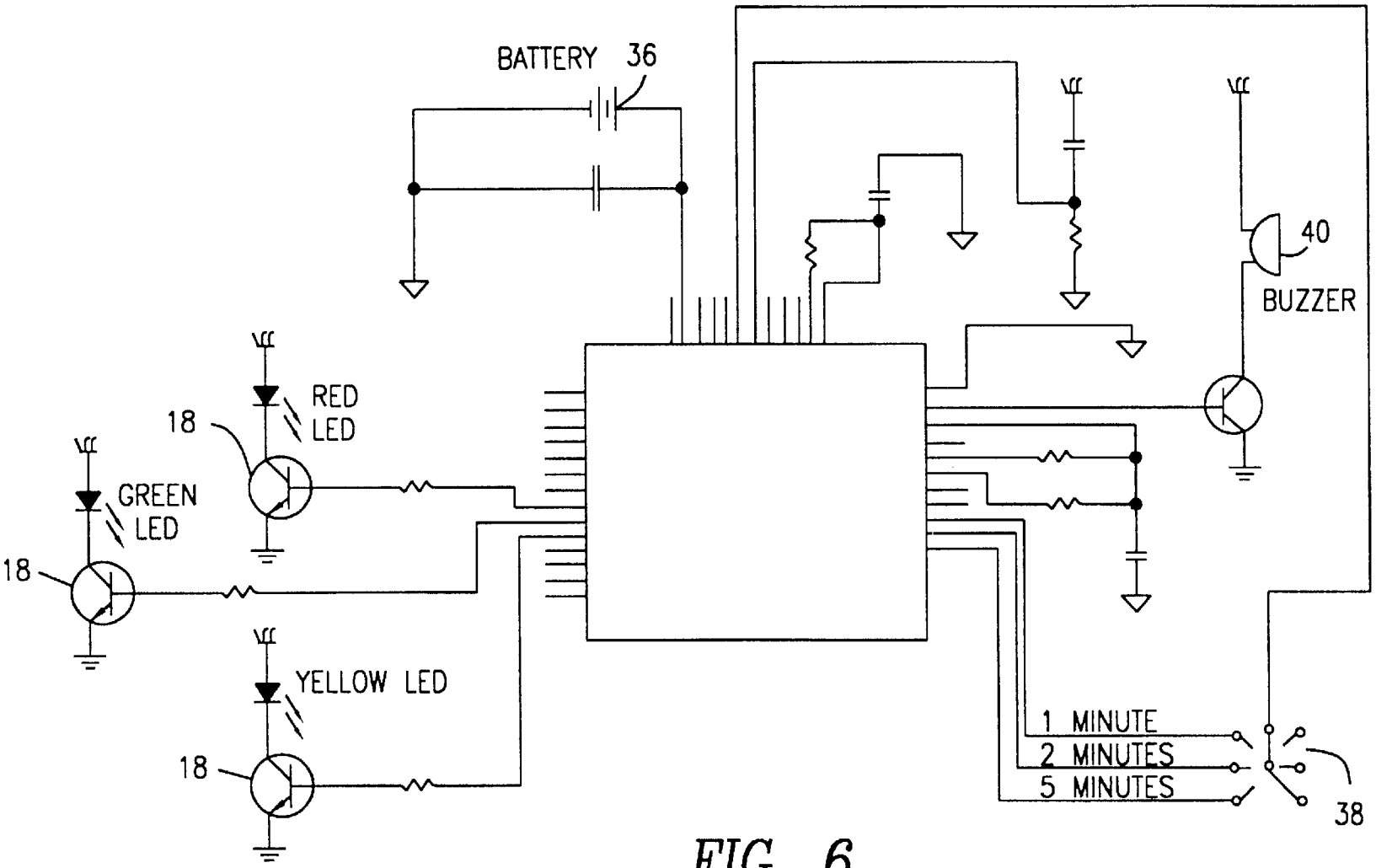
FIG. 6 is an electronic schematic diagram of the circuitry of the preferred embodiment of the present invention.

FIG. 6 shows an electrical diagram of a preferred embodiment of the invention. A battery 36 is connected to the circuit and a timer delay 38 with settings of 1, 2 and 5 minutes as well as an alarm indicator in the form of a buzzer 40 are also connected on the circuit. The electrical circuit represents one possible embodiment of the invention.

Various other modifications and alterations derived from the above description will be apparent to those skilled in the art, including modifications based on the above. For example, the alarm body 10 can have a weighted base without arms.

All such variations and modifications are intended to fall within the spirit and scope of the present structure limited solely by the appended claims.

What is claimed is:

1. A refrigerator alarm comprising a light sensor, a timer associated with said light sensor, a temperature sensor and an alarm indicator having an alarm body wherein said alarm includes a self-contained power source consisting of a battery.

2. The refrigerator alarm of claim 1 wherein the alarm indicator is activated upon a predetermined period in which light is continuously detected.

3. The refrigerator alarm of claim 1 further comprising a manually activated switch for resetting the alarm indicator associated with the light sensor.

4. The refrigerator alarm of claim 3 wherein the manually activated switch is taken from the group consisting of a button, a toggle and a touch sensor.

5. The refrigerator alarm of claim 1 wherein the alarm indicator comprises an audio alarm.

6. The refrigerator alarm of claim 5 wherein said alarm indicator includes different alarm sounds corresponding to high temperature, low temperature and an open door.

7. The refrigerator alarm of claim 1 wherein the alarm indicator comprises a visual alarm.

8. The refrigerator alarm of claim 7 wherein the alarm indicator includes a series of LEDs relating to high temperature, low temperature and normal temperature.

9. The refrigerator alarm of claim 1 further comprising an adjustable time delay switch for adjusting the period of delay between sensing light and triggering said alarm.

10. The refrigerator alarm of claim 1 further comprising means for mounting the alarm onto a refrigerator shelf.

11. The refrigerator alarm of claim 10 wherein the means for mounting comprises an alarm body, said alarm body comprising an elongated upper arm and an elongated lower arm, with at least one of said upper arm and said lower arm being hinged and pivotable.

12. The refrigerator alarm of claim 10 wherein said lower arm is further comprised of a curved interior surface.

13. The refrigerator alarm of claim 10 wherein said upper arm is further comprised of a flat surface.

14. The refrigerator alarm of claim 10 wherein the mounting means comprises a mounting bracket having a first side and a second side wherein the first side includes connection means to engage the alarm body and said second side is associated with attachment means for attachment to an interior surface of the refrigerator.

15. The refrigerator alarm of claim 14 wherein said connection means comprises one or more fasteners cooperating with one or more receptacles associated with the alarm body and mounting bracket.

16. A refrigerator alarm comprising a light sensor, a timer associated with said light sensor, a temperature sensor and an alarm indicator having an alarm body, further comprising means for mounting the alarm onto a refrigerator shelf comprising a mounting bracket having a first side and a second side wherein the first side includes connection means to engage the alarm body and said second side is associated with attachment means for attachment to an interior surface of the refrigerator wherein the attachment means is taken from the group consisting of double sided tape, suction cups and Velcro.

17. A refrigerator alarm comprising a light sensor, a timer associated with said light sensor, a temperature sensor and an alarm indicator having an alarm body, further comprising means for mounting the alarm onto a refrigerator shelf wherein the mounting means is taken from the group consisting of double sided tape, suction cups and Velcro.

* * * * *